United States Patent [19]

Kakimi

[11] Patent Number: 4,476,212

[45] Date of Patent: Oct. 9, 1984

[54] PREPARATION OF ELECTROSTATOGRAPHIC TONER MATERIAL

[75] Inventor: Fujio Kakimi, Shizuoka, Japan

[73] Assignee: Fuji Photo Film Co., Ltd., Kanagawa, Japan

[21] Appl. No.: 452,502

[22] Filed: Dec. 23, 1982

[30] Foreign Application Priority Data

Dec. 25, 1981 [JP] Japan ..... 56-209278

[51] Int. Cl.[3] ..... G03G 9/08; G03G 9/10

[52] U.S. Cl. ..... 430/137; 430/110; 427/212; 427/214; 427/221; 427/222

[58] Field of Search ..... 430/110, 137; 427/212, 427/214, 218, 219, 221, 222

[56] References Cited

U.S. PATENT DOCUMENTS 4,139,483 2/1979 Williams et al. ..... 430/110

FOREIGN PATENT DOCUMENTS 54-8535 1/1979 Japan ..... 430/110
57-53756 3/1982 Japan ..... 430/137
1462181 1/1977 United Kingdom ..... 427/212

OTHER PUBLICATIONS

Khanna, "Surfactant-Free Emulsion Polymerization Process", Res. Discl., Jul. 1977, p. 56.

*Primary Examiner*—Roland E. Martin
*Attorney, Agent, or Firm*—Toren, McGeady and Stanger

[57] ABSTRACT

In a process for the preparation of an electrostatographic toner material suitably employable for pressure fixing process, comprising encapsulating a core material containing colorant with a shell material selected from the group consisting of a melamine resin and a urea resin in an aqueous medium to prepare encapsulated toner particles and spray-drying the so prepared toner particles, the improvement in which the spray-drying of the toner particles is carried out in the presence of a cationic compound selected from the group consisting of a cationic surface active agent and a cationic polymer.

4 Claims, No Drawings

PREPARATION OF ELECTROSTATOGRAPHIC TONER MATERIAL

This invention relates to a process for the preparation of an electrostatographic toner material, and more particularly relates to a process for the preparation of a pressure fixable electrostatographic toner material comprising encapsulated toner particles.

There is known the electrostatography which comprises developing a tone electrostatic latent image contained on a photoconductive or dielectric surface with a toner material containing colorant and a fixing aid to produce a visible toner image, and transferring and fixing the visible toner image onto a surface of a support medium such as a sheet of paper.

The development of the latent image to produce a visible toner image is carried out by the use of either a developing agent consisting of a combination of toner material with carrier particles, or a developing agent consisting of toner material only. The developing process utilizing the combination of toner material and carrier particles is named "two component developing process", while the developing process utilizing only the toner material is named "one component developing process".

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither the heating procedure nor the solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is said to be an advantageous fixing process inherently having a variety of preferable features.

However, the pressure fixing process also has a variety of inadvantageous features. For instance, the pressure fixing process generally provides poorer fixability than the heat fixing process does, whereby the toner image fixed onto a paper is apt to rub off easily. Further, the pressure fixing process requires very high pressure for the fixing, and such a high pressure tends to break the cellulose fibers of the support medium such as paper and also produces glossy surface on the support medium. Moreover, the pressing roller requires to have relatively greater size, because the roller necessarily imparts very high pressure to the toner image on the support medium. Accordingly, reduction of the size of a copying and duplicating machine cannot exceed a certain limit defined by the size of the pressing roller.

There has been previously proposed an encapsulated toner material which comprises toner particles enclosed with micro-capsules, so as to overcome the above-described disadvantageous features of the pressure fixing process. The encapsulated toner material is prepared by enclosing core particles (containing colorant such as carbon black) with shells which are rupturable by the application of pressure. The so-prepared encapsulated toner material has various advantageous features; for instance, the fixing of the encapsulated toner material does not require very high pressure, and the fixability is excellent. Accordingly, the encapsulated toner material is viewed as suitable for the use in the pressure fixing process. However, the encapsulated toner materials proposed up to now appear unsatisfactory in practical use, because they are not able to satisfy some of the characteristics required for providing smooth copying and duplicating operation and for accomplishing excellent toner image fixability and quality.

More in detail, it is required for the toner material for the use as a dry type developing agent in the electrostatography to have excellent powder characteristics (or powder flow properties) to provide high development quality, and to be free from staining the surface of the photosensitive material on which the latent image is formed. The term "powder characteristics" particularly means resistance to agglomeration and blocking of the toner particles. In the process for the preparation of an encapsulated toner material, the toner material is generally separated from a toner dispersed solution and dried through a spray-drying procedure. The previously known encapsulated toner material is apt to undergo agglomeration either in the spray-drying process, or in the storage period after the spray-drying. The so agglomerated toner material markedly degrades the resolution of the visible toner image produced on the electrostatographic latent image, whereby markedly decreasing the sharpness of the visible toner image fixed onto the support medium.

Further, a toner material employed for the two component developing process is also required not to stain the surfaces of the carrier particles. The toner material for the use as a developing agent in the pressure fixing process is furthermore required to be satisfactory in the fixability under pressure and not to undergo offsetting against the roller surface, that is, phenomenon in which the toner adheres to the roller surface so as to stain it.

The encapsulated toner materials proposed until now are not satisfactory, at least, in one of these requirements for the developing agent to be employed for the pressure fixing process.

It is, accordingly, an object of the invention to provide a process for the preparation of an electrostatographic toner material free from the drawbacks described above.

It is another object of the invention to provide a process for the preparation of an encapsulated toner material suitably employed for the pressure fixing process and free from the drawbacks described above.

It is a further object of the invention to provide a process for the preparation of an encapsulated toner material suitably employed for the pressure fixing process, whose powder characteristics are remarkably improved.

It is a still further object of the invention to provide a process for the preparation of an encapsulated toner material having improved pressure fixability in addition to the improved powder characteristics.

It is a still further object of the invention to provide a process for the preparation of an encapsulated toner material having improved resistance to the offsetting in addition to the improved powder characteristics and the improved pressure fixability.

It is a still further object of the invention to provide a process for the preparation of an encapsulated toner material which is resistant to rupture prior to the pressing operation in the pressure fixing process, while which is readily rupturable in the pressure fixing operation.

The above-described objects and other objects which will be apparent from the hereinafter-given description are accomplished by the present invention, that is, in a process for the preparation of an electrostatographic toner material comprising encapsulating a core material containing colorant with a shell material selected from the group consisting of a melamine resin and a urea resin in an aqueous medium to prepare encapsulated toner particles and spray-drying the so prepared toner particles, the improvement in which the spray-drying of the toner particles is carried out in the presence of a cationic compound selected from the group consisting of a cationic surface active agent and a cationic polymer.

The process for encapsulating a core material containing colorant with a shell material such as a melamine resin or a urea resin in an aqueous medium is already known to those skilled in the art. For instance, the encapsulation with a melamine resin is described in Japanese Patent Provisional Publications No. 55(1970)-15660, No. 55(1970)-47139, and No. 56(1971)-51238, and U.S. Pat. Nos. 4,100,103, and 4,233,178. The encapsulation with a urea resin is described, for instance, in Japanese Patent Provisional Publication No. 55(1970)-119438 and U.S. Pat. No. 4,221,710.

The process for the encapsulation of the invention can be carried out in the manners described in these publications. A preferred process for the encapsulation is as follows:

A hydrophobic liquid (core material) containing a colorant is emulsified in an aqueous medium containing at least one anionic protective colloid. To the so prepared emulsion is added a combination of melamine and formaldehyde, or a melamine-formaldehyde precondensate, and the aqueous mixture is then subjected, for instance, to adjustment in pH or to heating so as to undergo a polymerization reaction around the oily droplets of the core material.

In the above-described preferred process, the anionic protective colloid serves for dispersing the hydrophobic liquid in the form of very small droplets in the aqueous medium, as well as keeping these droplets from agglomeration. The anionic protective colloid can be prepared by the use of an anionic polymer. Examples of the anionic polymers include polyethylenesulfonic acid salt, polyvinylsulfate ester salt, maleic anhydride-styrene copolymer, maleic anhydride-isobutylene copolymer, maleic anhydride-ethylene copolymer, maleic anhydride-methyl vinyl ether copolymer, carboxylated polyvinyl alcohol, gum arabic, polyacrylic acid salt, a polyacrylic acid derivative, an acrylic acid copolymer, carboxymethylcellulose, gelatin, phthalated gelatin, succinated gelatin, other gelatin derivative, cellulose-sulfuric acid ester, alginic acid salt.

In the process of the invention, the dispersion containing the so encapsulated toner particles is spray-dried in the presence of the cationic compound selected from the group consisting of a cationic surface active agent and a cationic polymer. Accordingly, the anionic protective colloid is preferably removed from the dispersion in advance of carrying out the spray-drying. The removal of the anionic protective colloid from the dispersion can be carried out, for instance, by washing with water which involves precipitating the encapsulated toner particles through centrifugal separation, removing the supernatant liquid, dispersing the so separated toner particles in water, and then subjecting the dispersion to centrifugal separation. Such washing is preferably repeated more than twice.

The core material of the invention contains colorant for producing a visible image from the latent image. The colorant generally is a dye or a pigment, but a certain agent providing no directly visible image such as a fluorescent substance can be employed as the colorant, if desired.

The colorant is generally selected from a variety of the dye, pigment and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivitive dye; yellow colorants such as a benzidine derivative colorant, that is generally called Diazo Yellow; and red colorants such as Rhodamine B Lake that is a double salt of xanthin dye with phosphorus wolframate and molybdate, Carmine 6B belonging to Azo pigment, and a quinacridone derivative.

The core material of the invention contains a binder (adhesive material) for keeping the colorant within the core and assisting the fixing of the colorant onto the surface of a support medium such as paper. The binder is generally selected from high-boiling liquids conventionally employed or proposed for employment for finely dispersing an oil-soluble photographic additive within an aqueous medium to incorporate the additive into a silver halide color photosensitive material, or selected from polymers proposed for employment as the binders for the pressure fixable encapsulated toner materials.

Examples of the high-boiling liquids include the following compounds having the boiling point of higher than 180° C.:

(1) Phthalic esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl) phosphate, tributyl phosphate, trihexyl phosphate, trioctyl phosphate, trinonyl phosphate, tridecyl phosphate, trioleyl phosphate, tris-(butoxyethyl) phosphate, tris(chloroethyl) phosphate, tris(dichloropropyl) phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate;

(5) Aliphatic acid esters hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphthalene, ethylnaphthalene, diethylnaphthalene, triethylnaphthalene, monoisopropylnaphthalene, diisopropylnaphthalene, tetraisopropylnaphthalene, monomethylethylnaphthalene, isooctylnaphthalene;

(7) Dialkylphenyl ethers di-o-methylphenyl ether, di-m-methyldiphenyl ether, di-p-methylphenyl ether;

(8) Amides of fatty acids and aromatic sulfonic acid

N,N-dimethyllauroamide, N,N-diethylcaprylamide, N-butylbenzenesulfonamide;

(9) Trimellitic acid esters trioctyl trimellitate;

(10) Diarylalkanes diarylmethanes such as dimethylphenylphenylmethane, diarylethanes such as 1-methylphenyl-1-phenylethane, 1-dimethylphenyl-1-phenylethane and 1-ethylphenyl-1-phenylethane.

The above-listed high-boiling liquids and examples of other high-boiling liquids employable in the invention are described in detail in the following publications:

Japanese Patent Publications No. 46(1971)-23,233 and No. 49(1974)-29,461; Japanese Patent Provisional Publications No. 47(1972)-1,031, No. 50(1975)-62,632, No. 50(1975)-82,078, No. 51(1976)-26,035, No. 51(1976)-26,036, No. 51(1976)-26,037, No. 51(1976)-27,921, and No. 51(1976)-27,922; U.S. Pat. Nos. 2,322,027, 2,353,262, 2,533,514, 2,835,579, 2,852,383, 3,287,134, 3,554,755, 3,676,137 3,676,142, 3,700,454, 3,748,141, 3,837,863, and 3,936,303; British Pat. Nos. 958,441, 1,222,753, 1,346,364, and No. 1,389,674; and West Germany Offenlegungsschrift No. 2,538,889.

For the purpose of the invention, the high-boiling liquid is preferably selected from the phthalic acid esters, phosphoric acid esters and alkylnaphthalenes.

Examples of the polymers include the following polymers:

polyolefins, olefin copolymers, polystyrene, styrenebutadiene copolymer, epoxy resins, polyesters, natural and synthetic rubbers, polyvinylpyrrolidone, polyamides, cumarone-indene copolymer, methyl vinyl ether-maleic anhydride copolymer, maleic acid-modified phenol resin, phenol-modified terpene resin, silicone resins, epoxy-modified phenol resin, amino resins, polyurethane elastomers, polyurea elastomers, homopolymers and copolymers of acrylic acid ester, homopolymers and copolymers of methacrylic acid ester, acrylic acid-long chain alkyl methacrylate copolymer oligomer, poly(vinyl acetate), and poly(vinyl chloride).

The above-listed polymers and examples of other polymers employable in the invention are described in detail in the following publications:

Japanese Patent Publications No. 48(1973)-30,499, No. 49(1974)-1,588 and No. 54(1979)-8,104; Japanese Patent Provisional Publications No. 48(1973)-75,032, No. 48(1973)-78,931, No. 49(1974)-17,739, No. 51(1976)-132,838, No. 52(1977)-98,531, No. 52(1977)-108,134, No. 52(1977)-119,937, No. 53(1978)-1,028, No. 53(1978)-36,243, No. 53(1978)-118,049, No. 55(1980)-89,854 and No. 55(1980)-166,655; and U.S. Pat. Nos. 3,788,994 and 3,893,933.

The core material of the invention can further contain a magnetizable substance, preferably in the form of fine particles.

As for the magnetizable substances, there are given descriptions, for instance, in Japanese Patent Provisional Publications No. 53(1978)-118,053, No. 53(1978)-1,028 and No. 55(1980)-166,655. Examples of materials of the magnetizable substances include metals such as cobalt, iron and nickel; metal alloys or metal compositions comprising aluminum, cobalt, copper, iron, lead, magnesium, nickel, tin, zinc, gold, silver, antimony, beryllium, bismuth, cadmium, calcium manganese, titanium, tungsten, vanadium and/or zirconium; metallic compounds including metal oxides such as aluminium oxide, ferric oxide, cupric oxide, nickel oxide, zinc oxide, zirconium oxide, titanium oxide and magnesium oxide; refractory metal nitrides such as chromium nitride; metal carbides such as tungsten carbide and silica carbide; ferromagnetic ferrite; and their mixtures.

The releasing agent can be further contained in the core material for keeping the ruptured shell and the released core material from adhering to the surface of the pressing roller. The releasing agent can be chosen from those proposed for employment in the previously reported encapsulated toners. Examples of the releasing agents include a fluorine-containing resin described in Japanese Patent Provisional Publications No. 55(1980)-142,360 and No. 55(1980)-142,362.

Dispersing or emulsifying the reaction liquid can be carried out by means of a known homogenizer such as one belonging to the stirring type, the high pressure injecting type, the ultrasonic vibrating type and the kneader type. Particularly preferred homogenizers are a colloid mill, a conventional homogenizer, and an electromagnetic distortion inducing ultrasonic homogenizer.

In the process of the invention, the spray-drying of the dispersion containing the toner particles in the presence of the cationic compound is generally carried out by introducing initially a cationic compound into the dispersion and then subjecting the dispersion to the spray-drying. The introduction of the cationic compound can be done by adding the cationic compound as such or in the form of an aqueous solution to the toner particles dispersion, or adding the toner particles separated from the aqueous medium or water to an aqueous solution containing the cationic compound.

There are no specific limitations on the cationic surface active agent and the cationic polymer, as far as these are soluble in water or an aqueous medium.

Examples of the cationic surface actives include higher alkylamines, tertiary ammonium salts, quaternary ammonium salts, pyridinium salts, other heterocyclic type cationic surface active agents, phosphonium salts, and sulfonium salts. More concretely, there can be mentioned dodecyltrimethylammonium chloride, dioctadecyldimethylammonium chloride, octadecyldimethylmethallylammonium chloride, octadecyltrihydroxyethylammonium hydroxide, octadecylhydroxyethyldimethylammonium hydroxide, octadecylphenyldimethylammonium methylsulfate, dodecylpyridinium halide, dodecylpyridinium phenylsulfate, and alkylguanidine, Other cationic surface active agents employable in the process of the invention are described in "Synthesis and Application of Surface Active Agent" written by Ryohei Oda & Kazuhiro Teramura (Maki Shoten, Japan), pp. 107–135.

Examples of the cationic polymers include polymers containing tertiary ammonium salt, quaternary ammonium salt, pyridinium salt, phosphonium salt, sulfonium salt, etc., in the side chain or skeleton, and polyethyleneimine. More concretely, there can be mentioned polyethyleneimine, polydiethylaminoethylmethacrylate hydrochloride, polyvinylpyridinium salt, and polyvinylbenzyltrimethylammonium salt.

The cationic surface active agent and the cationic polymer can be employed singly or in combination. The amount of the cationic compound to be added to the toner particles is generally in the range of 0.1 to 30% by weight of the amount of the particles (total amount of the core material and the shell material), preferably 0.5 to 10% by weight, and more preferably 0.5 to 5 % by weight.

The spray-drying procedure is well known to those skilled in the art. Accordingly, no detailed description on the spray-drying procedure is necessary.

The spray-drying of the encapsulated toner particles together with the cationic compound can be carried out in any of the known procedure. As for the spraying system, there are known various means such as a pressurized nozzle, a rotary disk, or a double flow nozzle. As for the drying system, there are known various processes such as a horizontal parallel flow process, a vertical descending parallel flow process, a vertical ascending counterflow process, and a vertical descending mixed flow process. The conditions for the spray-drying employed in the invention can be set in accordance with the conventional conditions.

A dry encapsulated toner can be admixed with a flow lubricant such as hydrophobic silica powder so that the flow lubricant can be dispersed over the surface of the encapsulated toner. The encapsulated toner having the flow lubricant such as hydrophobic silica powder over the toner surface shows particularly improved powder quality and property, and accordingly is very advantageous in the practical use.

The encapsulated toner obtained as above can be introduced into the electrostatographic copying and duplicating machine to develop and electrostatographically produced latent image so as to produce a visible toner image on the surface of the photoconductive material. The visible image is then fixed onto a support medium such as paper by means of an appropriate pressure fixing apparatus. There is no limitation on the pressure fixing apparatus for fixing the encapsulated toner of the invention, and any known apparatus can be applied to the fixing of the encapsulated toner of the invention. Examples of the pressure fixing apparatuses include those illustrated in Japanese Patent Publications No. 44(1969)-9,880, No. 44(1969)-12,797, and No. 46(1971)-15,876; and Japanese Patent Provisional Publications No. 49(1974)-62,143, No. 49(1974)-77,641, No. 50(1975)-51,333, No. 51(1976)-31,235, No. 51(1976)-40,351, No. 52(1977)-15,335, No. 52(1977)-102,743, No. 54(1979)-28,636, No. 54(1979)-32,326, No. 54(1979)-41,444, and No. 54(1979)-48,251.

The electrostatographic toner material prepared according to the invention has improved powder characteristics, and further is resistant to the mechanical shock and abrasion in the developing apparatus of the electrostatographic copying and duplicating machine. Further, the electrostatographic toner material is easily rupturable in the pressure fixing apparatus to produce a visible toner image well fixed onto the support medium such as paper. Furthermore, the toner material hardly undergoes off-setting to a pressing roller and hardly undergoes the so-called filming on the surfaces of the carrier particles, the developing sleeves and the photoconductive material.

Other features of the electrostatographic copying and duplicating process employing an encapsulated toner material are described in U.S. Pat. No. 3,788,994, which is introduced hereinto as reference.

The present invention will be illustrated by the following examples which are by no means intended to introduce any restriction into the invention.

EXAMPLE 1

In 95 g. of hot water at approximately 80° C. was dissolved 5 g. of polyvinylbenzenesulfonic acid partly in the form of the sodium salt (mean molecular weight 500,000) under stirring. The mixture was further stirred for approximately for 30 min. to become a solution. The solution was cooled, and an aqueous sodium hydroxide solution (20% by weight aqueous solution) was added to the cooled solution (pH 2–3) to adjust the pH to 4.0. Thus, a solution containing a protective colloid was prepared.

A dispersion of 10 g. of carbon black in 100 g. of alkylnaphthalene (principal ingredient: diisopropylnaphthalene) was added to the above-obtained solution, and the mixture was emulsified to obtain an emulsion containing oily droplets of average diameter 10 μm.

Independently, 6 g. of melamine, 11 g. of aqueous formaldehyde (37% by weight solution), and 83 g. of water were heated to 60° C. under stirring. The stirring was continued for 30 min. at the temperature to produce an aqueous melamine-formaldehyde precondensate solution (pH 6–8).

The aqueous precondensate solution was then added to the above-obtained emulsion, and the mixture was adjusted to pH 6.0 with aqueous acetic acid (20% by weight). The aqueous mixture was subsequently heated to 65° C. and kept at the temperature for 2 hours under stirring. Thereafter, the mixture was cooled to room temperature, and adjusted to pH 9.0 with an aqueous sodium hydroxide solution (20% by weight solution), completing the encapsulating reaction.

The so obtained dispersion containing the encapsulated toner particles was separated from the protective colloid through centrifugal separation. The collected toner particles were washed with water by carrying out three times a procedure involving addition of water and centrifugal separation. The so washed toner particles were dispersed in 240 g. of an aqueous solution containing dodecyltrimethylammonium chloride (0.5% by weight solution). The dispersion was then stirred well and subjected to spray-drying by means of a spray-dryer (manufactured by Yamato Kagaku Co., Ltd., Japan) under the conditions of the entrance temperature: 200° C. the exit temperature: 90° C., and the atomizing pressure: 4 kg./cm$^2$ to obtain a powdery toner material.

2 g. of the so prepared toner material was taken out into a vessel made of a synthetic plastic material, and then 10 mg. of hydrophobic silica micro-powder into the vessel. Both materials were mixed and examined on the powder characteristics. Microscopic observation on the toner material indicated that the toner particles were present independently and that no bulky agglomerated particles were formed.

The evaluation of the toner material was carried out as follows.

Five parts by weight of the toner material were admixed with 95 parts by weight of powdery iron carrier in a shaking apparatus to prepare a developing agent. It was confirmed through microscopic observation for the above toner material that the developing agent contained no ruptured toner particles.

A conventional electrostatographic copying and duplicating process was carried out using the above developing agent. The visible toner image produced on a latent image was then converted onto a paper. The paper carrying the toner image was treated under a pressing roller at a pressure of 350 kg./cm$^2$. There was obtained a toner image with high sharpness and well fixed onto the paper. Further, off-setting of the toner was at a very low level.

EXAMPLE 2

The procedure for the preparation of the toner material described in Example 1 was repeated except that the toner particles washed with water were dispersed in 240 g. of an aqueous solution containing polyethyleneimine (P-1000, produced by Nippon Catalyst Chemical Industries Co., Ltd., Japan, 0.5% by weight solution) in place of 240 g. of the aqueous solution containing dodecyltrimethylammonium chloride (0.5% weight solution).

2 g. of the so prepared toner material was taken out into a vessel made of a synthetic plastic material, and then 10 mg. of hydrophobic silica micro-powder into the vessel. Both materials were mixed and examined on the powder characteristics. Microscopic observation on the toner material indicated that the toner particles were present independently and that no bulky agglomerated particles were formed.

The evaluation of the toner material was carried out as follows.

Five parts by weight of the toner material were admixed with 95 parts by weight of powder iron carrier in a shaking apparatus to prepare a developing agent. It was confirmed through microscopic observation for the above toner material that the developing agent contained no ruptured toner particles.

A conventional electrostatographic copying and duplicating process was carried out using the above developing agent. The visible toner image produced on a latent image was then converted onto a paper. The paper carrying the toner image was treated under a pressing roller at a pressure of 350 kg./cm$^2$. There was obtained a toner image with high sharpness and well fixed onto the paper. Further, off-setting of the toner was at a very low level.

I claim:

1. In a process for the preparation of an electrostatographic toner material comprising encapsulating a core material containing colorant with a shell material selected from the group consisting of a melamine resin and a urea resin in an aqueous medium to prepare encapsulated toner particles and spray-drying the so prepared toner particles, the improvement in which the spray-drying of the toner particles is carried out in the presence of a cationic compound selected from the group consisting of a cationic surface active agent and a cationic polymer, and the spray-dried toner particles are then provided with a hydrophobic silica flow lubricant.

2. The process for the preparation of an electrostatographic toner material claimed in claim 1, in which the shell material is a melamine resin.

3. The process for the preparation of an electrostatographic toner material claimed in claim 1, in which the cationic compound is a quaternary ammonium salt.

4. The process for the preparation of an electrostatographic toner material claimed in claim 1, in which the cationic compound is polyethyleneimine.

* * * * *